United States Patent [19]

Adachi et al.

[11] 4,152,480

[45] May 1, 1979

[54] METHOD FOR MAKING NONWOVEN FABRIC AND PRODUCT

[75] Inventors: Kiyoshi Adachi; Hiroshi Kitagawa, both of Nagoya; Masaru Uehara, Komaki; Shigeki Muramatsu; Toshio Kobayashi, both of Nagoya, all of Japan

[73] Assignee: Mitsubishi Rayon Company, Limited, Tokyo, Japan

[21] Appl. No.: 816,073

[22] Filed: Jul. 15, 1977

Related U.S. Application Data

[63] Continuation-in-part of Ser. No. 810,882, Jun. 28, 1977, abandoned.

[30] Foreign Application Priority Data

Jun. 28, 1976 [JP] Japan ..... 51-76248

[51] Int. Cl.[2] ..... D04H 1/46; D04H 1/72; D04H 5/02

[52] U.S. Cl. ..... 428/227; 28/104

[58] Field of Search ..... 8/10, 882; 28/104, 105; 428/224, 227, 234, 235

[56] References Cited

U.S. PATENT DOCUMENTS

| | | | |
|---|---|---|---|
| 2,981,999 | 5/1961 | Russell | 28/104 |
| 3,906,130 | 9/1975 | Tsurumi et al. | 28/104 X |
| 4,085,485 | 4/1978 | Brandon et al. | 28/104 |

FOREIGN PATENT DOCUMENTS

| | | | |
|---|---|---|---|
| 731854 | 4/1966 | Canada | 28/105 |
| 432934 | 12/1974 | U.S.S.R. | 28/104 |

*Primary Examiner*—Louis Rimrodt
*Attorney, Agent, or Firm*—Oblon, Fisher, Spivak, McClelland & Maier

[57] ABSTRACT

Nonwoven fabrics are made by continuously expelling a high pressure liquid jet stream in the form of a film through a slit-shaped nozzle onto a web placed on a support.

13 Claims, No Drawings

METHOD FOR MAKING NONWOVEN FABRIC AND PRODUCT

This application is a continuation-in-part of application Ser. No. 810,882, filed June 28, 1977, now abandoned.

BACKGROUND OF THE INVENTION

1. Field of the Invention

The present invention relates to improvements in a method for making nonwoven fabrics whose nonwoven shape is held in position by friction resistance and/or entanglement of the individual fibers, without using any special binder to hold the fibers together.

2. Description of the Prior Art

Among the methods employed in the past for making nonwoven fabrics of this kind is one in which fine spray liquid streams are sprayed onto a web through conical nozzles as disclosed in U.S. Pat. No. 2,862,251. In another technique, jets of fine columnar liquid streams are impelled onto a web through circular nozzles as disclosed in U.S. Pat. No. 3,485,706. However, in the former method which uses fine spray liquid streams, the dispersal of the force of the liquid stream is so large and the liquid stream collides with the web in such a fine spray that the force of impact is very small. Consequently, the individual fibers which form on the support do not arrange themselves very quickly and clearly in a shape corresponding to the numerous apertures in the supporter. That is, the rearranging efficiency or the patterning efficiency of the fibers and the speed at which the fibers entangle, as well as the strength of the entanglement, have both been insufficient. On the other hand, in the latter described method the dispersion of the liquid stream, which occurs in the first method, does not occur in the latter method. Furthermore, the impact force of the stream per unit area on the web is large, but the individual columnar liquid streams are so fine that they collide with the web in the form of little dots. Therefore, the absolute force of impact on the web is still small. Accordingly, the entangling efficiency, in which many fibers quickly entangle with each other, and the rearranging efficiency, or the quick rate at which the fibers rearrange with each other, are still unsatisfactory. Further, in the method of the columnar liquid stream, clear linear loci are described on the web surface by the relative motion of the above-mentioned circular nozzle and the web. Accordingly, another deficiency of this method has been that uneven streaks of fiber are formed on the web.

A need, therefore, continues to exist for a method by which an entangled mass of fibers can be quickly formed on a web in an even thickness.

SUMMARY OF THE INVENTION

Accordingly, one object of the present invention is to provide a method for making nonwoven fabrics which are excellent both in their efficiency for rearranging and entangling the component fibers of a web by use of liquid streams, while at the same time eliminating the problems of the above-mentioned conventional methods.

Briefly, this object and other objects of the present invention, as hereinafter will become more readily apparent, can be attained by nonwoven fabrics prepared by continuously expelling a high pressure liquid jet stream, in the form of a film, through a slit-shaped nozzle onto a web placed on a support.

DESCRIPTION OF THE PREFERRED EMBODIMENTS

The film-shaped liquid stream used in the present invention is a continuous liquid stream having an angle of divergence of less than 5 degrees, which forms a jet through a slit-shaped nozzle. Such a film-shaped liquid stream possesses greatly reduced dispersive force characteristics and collides with a surface in the form of a clear, solid line with the web surface. Therefore, even if the impact force per unit area is substantially the same as in the case of the above-described columnar shaped liquid stream of the cited prior are reference, the absolute impact force on the web will be far larger than in the case of the above-mentioned columnar shaped liquid stream. Consequently, the rearranging efficiency and the entanglement efficiency of the resulting web will be further improved. Further, the film-shaped liquid stream of the present process describes a plane of loci on the web surface upon which it impinges because of the relative motion of the slit-shaped nozzle through which the stream is forced and the web. Consequently, the problem of uneven streaks which occurs in the prior art process, which employs a columnar shaped liquid stream, does not occur.

The following description describes a preferred embodiment of the present invention. First, the preferred range of the width of the outlet part of the slit nozzle used in the present invention is less than 0.5mm. That is to say, the force of impact of the liquid stream on the fiber web is defined by the product of the amount of liquid flow and the flow rate of the liquid stream, which impinges as jets onto the web in a unit time and will increase proportionally with an increase in these factors. With an increase in the width of the outlet part of the slit nozzle, the amount of flow of the jet liquid stream per unit length of the slit nozzle will increase and therefore the force of impact on the web will increase, as well as the above-mentioned treatment efficiencies. However, because a large amount of the liquid is instantaneously fed through the nozzle, the web will be submerged into the liquid and a so-called flood state will occur. If the width of the outlet part of the above-mentioned slit nozzle exceeds 0.5mm, a stablized treatment effect will be no longer obtained.

The preferred range of the amount of flow of the liquid jet corresponding to the outlet width of the slit nozzle, that is, the amount of flow of the liquid jet per unit time and unit area on the web ranges from 0.2 to 15.0 $l/min.cm^2$ or more, preferably 0.5 to 10.0 $l/min.cm^2$. If the amount of flow is less than 0.2 $l/min.cm^2$, and if the liquid stream jet velocity is increased, no sufficient treatment effect will be obtained. On the contrary, if the amount of flow exceeds 15.0 $l/min.cm^2$, which is the same effect achieved if the outlet width of the above-mentioned slit nozzle exceeds 0.5mm, no stabilized treatment effect will be obtained.

The preferred jet pressure of the film-shaped liquid stream through the slit nozzle is more than 5 $kg/cm^2$. That is, the jet velocity of the film-shaped liquid stream through the slit nozzle will increase with an increase in the liquid jet pressure and will diminish because of the resistance provided by air between the nozzle outlet and the web, upon which the liquid impinges, no matter how short the distance between the nozzle outlet and fiber web is made and no matter how large the amount of flow of the liquid jet. If the pressure of the jet through the above-mentioned slit nozzle is less than 5 kg/cm$^2$, only an insufficient treatment effect will be obtained.

The length of the outlet portion of the slit nozzle is preferably more than 5 mm. If it is less than 5 mm, the amount of flow of the liquid required to obtain a predetermined rearranging effect of the fibers on the web will increase to such an extent so as to be undesirable with respect to the rearranging efficiency. Furthermore, in the present invention, the slit nozzle is usually fixed in a position such that the lengthwise direction of the outlet portion has an angle or intersects at right angles with the travelling direction of the web. However, if it is reciprocated in the direction at right angles to the travelling direction of the web, it will still be effective in a uniform treatment and, in such a case, even if the lengthwise direction of the outlet portion of the slit nozzle is not at an angle, that is, parallel with the travelling direction of the web as the film-shaped liquid stream describes a plane of loci on the web surface, there will be no detrimental effects.

In the present invention, a plate-shaped object having numerous apertures or a net-shaped object is usually used as a support for the manufacture of nonwoven fabrics which has patterns corresponding to the numerous apertures of the plate-shaped object or to the mesh pattern of the net-shaped object. It is also possible to use an ordinary roll-shaped object which has no holes on the peripheral surface of the support for the fabrication of nonwoven fabrics which have no patterns. In this case, only the entangling efficiency of the above-mentioned film-shaped liquid stream will be substantially utilized.

If a laminate of two or more plate-shaped objects having many molding holes which differ in their open areas and number of openings or a laminate of two or more net-shaped objects which differ in mesh size is used for the support, nonwoven fabrics having complicated patterns of two or more kinds of overlapping patterns will also form.

In another embodiment of the present invention, a screen having openings can be used in an overlapped position below the above-mentioned support and/or above the web as required to stabilize the jet treatment. If the screen to be placed below the support has holes which are significantly smaller than the dimensions of the holes of the support, and if the liquid having passed through the web can be removed without any resistance, then the screen may be formed of any object such as a metal screen or a fabric. Also, if the screen, which is to be placed above the web, does not substantially diminish the force of impct of the liquid stream on the web, the screen may be formed of any material. Further, as required, a suction device which improves the water exchausting capacity may be provided below the support. The so-called "liquid stream" in the present invention is preferably of water in which is dissolved a powdered or fine granular solid material thereby forming an aqueous solution of varying viscosity as required. The angle of impact of the liquid stream with the web is at least 45 degrees, preferably 90 degrees.

Suitable fibers which can be used in the present invention may be any artificial fibers such as rayon, acetate, nylon, vinylon, a polyester, an acrylate, or a polyolefin. Such natural fibers as cotton pulp, hemp, silk and wool and such mineral fibers as glass and asbestos may be used in admixture with an artifical fiber. However, in consideration of the density which is to improved, and the bonding between the fibers, which is set by the after-processing step, it is desirable to use fibers having a latent shrinkability or which develope a self-bondability when heated or the like. The fineness of the fibers should be less than 15 deniers, preferably less than 6 deniers. The length of the fibers is not critical. The web may be formed of only short staple fibers, only continuous filaments, or mixtures of the short staple fibers and continuous filaments.

Having generally described this invention, a further understanding can be obtained by reference to certain specific examples which are provided herein for purposes of illustration only and are not intended to be limiting unless otherwise specified.

The present invention shall be explained in more detail in the following examples in which the angle of the lengthwise direction of the outlet portion of the slit nozzle and the travelling direction of the web is set at 90 degrees.

EXAMPLE 1

This particular embodiment shows how more efficient the use of a slit-shaped nozzle is than the use of circular nozzles in producing an open nonwoven fabric which has such excellent characteristics as softness and strength.

A web of a weight of about 100 g/m$^2$ made by cross-overlapping two carded webs of 2.6 denier per filament of 38 mm polyester staple fibers was used for the web. This web was placed on a supporting plate wherein the holes in the plate had a diameter of 0.3 cm and an open area of 51%. A metal screen of coarse mesh was then placed on the web. Jets of water were then impelled onto the web under various conditions and the web was dried at room temperature whereby an apertured nonwoven fabric whose strength, pattern clearness and other properties are shown in Table 1. Incidentally, the distance between the centers of the circular nozzles was set at 1 mm, the length of the slip-shaped nozzle was set at 10 cm and the distance between each nozzle and the web surface was set at 3 cm. As is clear from Table 1, when the web was subjected to columnar shaped water streams by the circular nozzles, the strength was improved by the needling effect. However, on the other hand, unless the number of the treatments was considerably increased, nonwoven fabrics of no clear pattern and of insufficient strength were obtained and the treating efficiency was very low, especially the patterning efficiency. On the other hand, it was found that when the film-shaped water stream, as produced by the slit nozzle was used, nonwoven fabrics of clear patterns and sufficient strength were obtained with very few treatments.

Table 1

| No. | Shape of nozzle | Width or diameter of nozzle (microns) | Jetting pressure (kg/cm$^2$) | Number of treatments | Weight (g/cm$^2$) | Tensile strength (kg/2.5cm) | Clearness of pattern |
|---|---|---|---|---|---|---|---|
| 1 | Slit | 80 | 3 | 20 | 100.1 | 1.2 | not clear |
| 2 | Slit | 80 | 10 | 10 | 101.2 | 3.5 | clear |
| 3 | Slit | 80 | 30 | 4 | 100.8 | 6.2 | clear |

Table 1-continued

| No. | Shape of nozzle | Width or diameter of nozzle (microns) | Jetting pressure (kg/cm$^2$) | Number of treatments | Weight (g/cm$^2$) | Tensile strength (kg/2.5cm) | Clearness of pattern |
|---|---|---|---|---|---|---|---|
| 4 | Slit | 80 | 50 | 3 | 98.6 | 7.8 | clear |
| 5 | Slit | 100 | 30 | 3 | 96.7 | 8.2 | clear |
| 6 | Slit | 400 | 30 | 3 | 102.1 | 6.9 | clear |
| 7 | Slit | 550 | 30 | 3 | 98.9 | — | (flood state) |
| 8 | Circular | 100 | 20 | 5 | 105.2 | 4.2 | not clear |
| 9 | Circular | 100 | 50 | 8 | 97.9 | 6.8 | not clear |
| 10 | Circular | 100 | 50 | 12 | 99.6 | 8.2 | not clear |
| 11 | Circular | 100 | 50 | 20 | 102.0 | 8.9 | clear |
| 12 | Circular | 100 | 70 | 20 | 104.9 | 8.7 | clear |

EXAMPLE 2

This embodiment of the present invention shows the relationship between the width of the outlet part of a slit nozzle and the effect on the jet water stream. The results of the measurements of the width of the outlet portion of the slit nozzle and the tensile strength of the obtained apertured nonwoven fabrics are shown in Table 2. An apertured plate of a thickness of 1 mm, whose hole diameter was of 3 mm and whose total open area was 51% was used for the supporting plate for the jets of the water stream. A web of a weight of 60 g/cm$^2$ made of polyester fibers of 1.5 deniers per filament, and a fiber length of 38 mm was used as the web. A nozzle, wherein the length of the outlet portion was 10 cm, was used for the slit nozzle. The pressure of the water stream jets through the slit nozzle was set at 20 kg/cm$^2$. The amount of jet water flow was set at 2 l/min.cm$^2$. The distance between the slit nozzle and the web was set at 4 cm, and the web was then subjected to jets of a water stream.

Table 2

| Width of outlet part (mm) | Tensile strength (kg/2.5 cm) |
|---|---|
| 0.1 | 4.0 |
| 0.25 | 4.3 |
| 0.40 | 3.9 |
| 0.50 | 3.6 |
| 0.55 | 2.5 (The pattern was rather unclear) |
| 0.60 | (A flood state was attained and patterning was impossible) |

EXAMPLE 3

This example shows the relationship between the amount of flow of a jet of a liquid stream through a slit nozzle and the effect of the jet of the liquid stream. The results of the measurements on the amount of flow of a water stream jet and the tensile strength of the obtained apertured nonwoven fabric are shown in Table 3.

An apertured plate of a thickness of 0.8 mm, having holes of a diameter of 2 mm and a total open area of 48% was used for the supporting plate for the water stream jets. A web of a weight of 40 g/m$^2$ and formed of viscose rayon staple fibers of 1.5 deniers per filament and 38 mm in length was used for the web. A nozzle, wherein the outlet portion had a width of 0.15mm and wherein the length of the outlet portion was 20 mm, was used for the slit nozzle. The distance between the slit nozzle and the web was set to 4 cm. The water stream was then impelled upon the web.

Table 3

| The amount of flow of water stream jet (l/min . cm$^2$) | Tensile strength (kg/2.5 cm) |
|---|---|
| 0.15 | Patterning was impossible |
| 0.2 | 0.5 |
| 0.5 | 4.5 |
| 1.0 | 5.5 |
| 4.0 | 6.4 |
| 10.0 | 5.2 |
| 15.0 | 2.5 |
| 16.0 | Patterning was impossible |

EXAMPLE 4

This example shows the relationship between the pressure of the liquid jet stream through a slit nozzle and the effect of the liquid jet stream. The results of the measurements of the pressure of the water stream jets and the tensile strength of the obtained apertured nonwoven fabric are shown in Table 4. A metal screen of 20 mesh per inch of a wire diameter of 0.3 mm and a total open area of 58.4% was used as the support for the web when subjected to the water jet stream. A web of a weight of 40 g/m$^2$ and formed of acryl staple fibers of 1.5 denier per filament, and a fiber length of 38 mm, was used for the web. A nozzle, wherein the width of the outlet portion was 0.4 mm and wherein the length of the outlet portion was 15 mm, was used for the slit nozzle. The amount of flow of the water jet stream was set at 4 l/min.cm$^2$. The distance between the nozzle and web was set at 4 cm. The web was thus subjected to a water jet stream.

Table 4

| Water stream jet pressure (kg/cm$^2$) | Tensile strength (kg/2.5 cm) |
|---|---|
| 4 | 2.8 (The pattern was rather unclear) |
| 5 | 5.3 |
| 10 | 8.1 |
| 30 | 10.0 |
| 45 | 10.3 |

EXAMPLE 5

This example shows the relationship between the length of the outlet part of a slit nozzle and the water stream jet efficiency or mostly the rearranging efficiency. The length of the outlet portion of the slit nozzle and the amount of flow of the water jet stream required to obtain a fixed rearranging effect (patterning effect) are shown in Table 5. An apertured plate of a thickness of 1 mm, having holes of a diameter of 2 mm and structured such that the distance between holes in the plate was 3 mm was used for the supporting plate in the water jet stream operation. A web of a weight of 60 g/m$^2$ and formed of polyester staple fibers of 2 denier per filament and a filament length of 51 mm was used for the web. A nozzle, wherein the width of the outlet portion was 0.25 mm, was used for the slit nozzle. The pressure of the water jet stream through the slit nozzle was set at 20 kg/cm$^2$. The distance between the slit nozzle and web was set at 3 cm. The water stream was then impelled upon the web.

Table 5

| Length of outlet portion (mm) | Required amount of flow of water jet stream (cc/cm$^2$) |
|---|---|
| 4.0 | 15.0 |
| 5.0 | 8.0 |
| 10.0 | 4.5 |
| 15.0 | 3.5 |

EXAMPLE 6

A web of a weight o 60 g/m$^2$ and formed of polyester staple fibers of 1.5 denier per filament, and a fiber length of 38 mm was used as the web. This web was placed on a supporting plate having holes of a diameter of 1.5 mm, a distance between holes of 2 mm, and a total open area of 51%. The web was covered with a metal screen of a coarse mesh and then was subjected to a jet of a film-shaped water stream under a stream pressure of 50 kg/cm$^2$ through a slit nozzle, whose outlet portion width was 50 microns and whose length was 60 mm. The jet of water was reciprocated in the direction at right angles to the travelling direction of the web. Then the treated web was peeled from the supporting plate and was dried at 120° C. whereby a nonwoven fabric of very uniform openings was obtained.

EXAMPLE 7

A web of a weight of 80 g/cm$^2$ and formed of viscose rayon fibers of 1.5 denier per filament and a fiber length of 51 mm was placed on a metal screen of 30 mesh per inch and was subjected to a jet of a film-shaped water stream under a stream pressure of 30 kg/cm$^2$ through a slit nozzle having an outlet portion width of 30 microns and a length of 60 mm, whereby a sheet of a tensile strength of 2 kg/25 mm was obtained. Then this sheet was fed onto a roller of a diameter of 100 mm, was treated with a jet of a film-shaped water stream under a stream pressure of 50 kg/cm$^2$ through the same slit nozzle as used above by using the roller as a support and was then dried at 110° C., whereby a patternless nonwoven fabric of a tensile strength of 7 kg/25 mm was obtained.

EXAMPLE 8

A web of a weight of 80 g/m$^2$ and formed of acryl fibers of 1.5 denier per filament and fibers of a length of 38 mm was used as a web. This web was interposed between two apertured supporting plates having open areas respectively of 2 and 20 mm$^2$. A film-shaped water stream jet under a stream pressure of 50 kg/cm$^2$ was expelled onto the web-plate laminate through a slit nozzle having an outlet portion whose width was 40 microns and whose length was 60 mm, from the side of the plate which had a total open area of 20 mm$^2$ and was then dried at 110° C., whereby an apertured nonwoven fabric having a complicated overlapping open pattern of the two supporting plates was obtained.

Having now fully described the invention, it will be apparent to one of ordinary skill in the art that many changes and modifications can be made thereto without departing from the spirit or scope of the invention as set forth herein.

What is claimed as new and intended to be secured by Letters Patent is:

1. A method for manufacturing nonwoven fabrics which comprises:

forcibly expelling a continuous high pressure liquid as a film from a slit-shaped nozzle having an outlet width of less than 0.5 mm onto a web of fibers which is on a travelling support; and forming nonwoven fabric from said fibers of said web by rearranging said fibers of said web by said high pressure liquid stream wherein the pressure of said high pressure liquid stream through the slit-shaped nozzle is more than 5 kg/cm$^2$ and the amount of said liquid stream forcibly expelled per unit time and unit area on the web is 0.2 to 15.0 l/min.cm$^2$.

2. The method of claim 1, wherein the lengthwise direction of the outlet portion of the slit-shaped nozzle is at an angle with respect to the travelling direction of the web.

3. The method of claim 1, wherein the slit-shaped nozzle is reciprocated in a direction at right angles to the travelling direction of the web.

4. The method of claim 1, wherein the support is a plate-shaped object having numerous apertures.

5. The method of claim 1, wherein the support is a net-shaped object.

6. The method of claim 1, wherein the support is a roll-shaped object which has no holes on its peripheral surface.

7. The method of claim 1, wherein the support is a laminate of at least two plate-shaped, objects having numerous apertures which differ in the size of the apertures and total open area of the surface.

8. The method of claim 1, wherein the support is a laminate of at least two net-shaped objects whose mesh sizes are different.

9. The method of claim 1 wherein said nonwoven fabrics comprise patternless nonwoven fabrics.

10. The method of claim 1 wherein said pressure of said high pressure liquid stream through the slit-shaped nozzle is between 5 kg/cm$^2$ and 70 kg/cm$^2$.

11. The method as set forth in claim 1 wherein the length of the outlet of the slit-shaped nozzle is more than 5 mm.

12. The method of claim 1 wherein said fibers comprise staple fibers or continuous filaments or a mixture of staple fibers and continuous filaments.

13. A nonwoven fabric prepared by the process of claim 1.

* * * * *